US008684139B2

(12) United States Patent
Leng

(10) Patent No.: US 8,684,139 B2
(45) Date of Patent: Apr. 1, 2014

(54) STEP STOOL

(75) Inventor: Luhao Leng, Xiamen (CN)

(73) Assignee: New-Tec Integration (Xiamen) Co., Ltd., Xiamen (CN)

( * ) Notice: Subject to any disclaimer, the term of this patent is extended or adjusted under 35 U.S.C. 154(b) by 205 days.

(21) Appl. No.: 13/127,074

(22) PCT Filed: Nov. 5, 2009

(86) PCT No.: PCT/CN2009/074815

§ 371 (c)(1),
(2), (4) Date: May 2, 2011

(87) PCT Pub. No.: WO2010/051764

PCT Pub. Date: May 14, 2010

(65) Prior Publication Data

US 2011/0209946 A1 Sep. 1, 2011

(30) Foreign Application Priority Data

Nov. 6, 2008 (CN) ..... 2008 2 0146256 U
Nov. 6, 2008 (CN) ..... 2008 2 0146257 U
Nov. 6, 2008 (CN) ..... 2008 2 0146258 U

(51) Int. Cl.
*E06C 1/387* (2006.01)
*E06C 1/20* (2006.01)

(52) U.S. Cl.
CPC .. *E06C 1/387* (2013.01); *E06C 1/20* (2013.01)
USPC ..... 182/165; 182/20; 182/22; 182/129; 182/228.3

(58) Field of Classification Search
USPC ..... 182/20, 22, 129, 165, 228.3
See application file for complete search history.

(56) References Cited

U.S. PATENT DOCUMENTS

| | | | | | |
|---|---|---|---|---|---|
| 159,627 | A | * | 2/1875 | Argerbright | 182/165 |
| 408,750 | A | * | 8/1889 | Rockwell et al. | 52/690 |
| 933,067 | A | * | 9/1909 | Ferry | 403/205 |
| 1,459,918 | A | * | 6/1923 | McGaw | 182/216 |
| 1,475,078 | A | * | 11/1923 | Messacar | 182/228.3 |
| 1,541,326 | A | * | 6/1925 | Clough | 182/228.3 |
| 1,575,689 | A | * | 3/1926 | Kalgren | 182/216 |
| 1,775,285 | A | * | 9/1930 | Little | 182/228.3 |
| 1,838,796 | A | * | 12/1931 | Tingleaf | 182/228.3 |
| 1,961,781 | A | * | 6/1934 | Reagle | 182/228.3 |
| 2,079,034 | A | * | 5/1937 | Parkin | 24/135 R |
| 2,192,521 | A | * | 3/1940 | McGaw | 182/228.3 |

(Continued)

FOREIGN PATENT DOCUMENTS

| | | | |
|---|---|---|---|
| CN | 2889017 | Y | 4/2007 |
| CN | 201108205 | Y | 9/2008 |

(Continued)

*Primary Examiner* — Alvin Chin Shue
*Assistant Examiner* — Colleen M Chavchavadze
(74) *Attorney, Agent, or Firm* — Rabin & Berdo, P.C.

(57) ABSTRACT

A step tool has front and rear leg tubes, a bottom and top footplate, a connection device for connecting the footplate and the leg tubes, a lock catch device of the top footplate. The front leg tubes are joined to the rear leg tubes rotatablely. The foreside of the top footplate joins to the front leg tubes rotatablely. A rail is fixed on the rear leg tubes. The lock catch is disposed on the top footplate and is detachly connected to the rail. The lock catch device includes two connecting ears, a rotation axis, a lock catch and a torsion spring.

16 Claims, 8 Drawing Sheets

(56) References Cited

U.S. PATENT DOCUMENTS

| | | | | |
|---|---|---|---|---|
| 2,300,018 | A * | 10/1942 | Shuck | 182/220 |
| 2,425,025 | A * | 8/1947 | Boisselier | 182/228.3 |
| 3,112,811 | A * | 12/1963 | Moran | 182/120 |
| 4,526,348 | A * | 7/1985 | Cammack | 256/65.06 |
| 6,026,933 | A * | 2/2000 | King et al. | 182/165 |
| 6,550,579 | B2 * | 4/2003 | Gibson et al. | 182/161 |
| 6,902,035 | B2 * | 6/2005 | Baumgartner et al. | 182/165 |
| 7,757,443 | B2 * | 7/2010 | Ringness | 52/182 |
| 2004/0000449 | A1 * | 1/2004 | Meeker | 182/106 |
| 2005/0029050 | A1 | 2/2005 | Baumgartner et al. | |
| 2005/0284701 | A1 * | 12/2005 | Gibson et al. | 182/165 |
| 2006/0070808 | A1 | 4/2006 | Moldthan et al. | |
| 2006/0102425 | A1 * | 5/2006 | Moldthan et al. | 182/129 |
| 2006/0266585 | A1 * | 11/2006 | Simpson | 182/129 |

FOREIGN PATENT DOCUMENTS

| | | | |
|---|---|---|---|
| CN | 201286503 | Y | 8/2009 |
| CN | 201297124 | Y | 8/2009 |
| CN | 201297125 | Y | 8/2009 |
| WO | WO-2005122837 | A1 | 12/2005 |

* cited by examiner

A

B

A–A

STEP STOOL

FIELD OF THE INVENTION

The present invention relates to a step stool.

BACKGROUND OF THE INVENTION

The existing step stool includes front leg tubes, rear leg tubes, a top footplate and a latch device. The front leg tubes pivotally join the rear leg tubes. The front portion of the top footplate pivotally joins the front leg tubes. A rail is provided between the rear leg tubes. The latch device is disposed in the top footplate and joins the rail, the leg tubes and a footplate disposed between the two leg tubes for assembly and disassembly. The step stool is used as a special ladder for a user to work on positions high above ground, the top footplate requires a solid connection to the other parts of the step stool. One such prior art step stool is described in the published patent application CN2889017Y entitled "A Latch Structure of the Step Stool" on Apr. 18, 2007 in the Chinese patent database in which a latch structure of the step stool is described. The latch structure includes a hook pivot to a first hinge plate, the hook rotates around the pivot point, the hook is disposed with a channel for the entry of the tongue fixed in the second hinge plate. A spring is fixed in the hook. A lock hook joins the hook rotatably by a pivot element. One end of the lock hook joins the free end of the spring fixed in the hook. The lock hook is disposed with a hook groove holding the tongue of the second hinge plate.

The release steps of the latch includes: 1. Rotate the lock hook, making the lock hook far away from the tongue; 2. continue to rotate the hook, making the hook far away from the tongue; 3. then rotate the first hinge plate relative to the second hinge plate, making the front leg tubes and the rear leg tubes fold together. As can be seen from the above, the release includes several steps with complicated release, resulting in inconvenient use.

SUMMARY OF THE INVENTION

The object of the present invention is to provide a step stool, which overcomes the disadvantages of the existing step stool that the latch device is complicated to release and difficult to use.

Another object of the present invention is to provide a latch device for connecting the footplate and the leg tubes in a step stool.

Another object of the present invention is to provide an antiskid structure of a step stool.

The technical proposal of the present invention to resolve the problem of the existing technology is:

A step stool comprising: two front leg tubes; two rear leg tubes, the two rear leg tubes joining the two front leg tubes pivotally, the two rear leg tubes having a rail therebetween; a bottom footplate attached between the two front leg tubes; a top footplate having a front end and a back end, the front end of the top footplate joining the two front leg tubes rotatably, the top footplate having two holes proximate to the back end, the back end of the footplate resting on the rail; a latching device located at the back end of the top footplate, the latching device comprising: a middle plate with two connecting ears, the two connecting ears passing through the holes of the top footplate and emerging from a bottom side of the top footplate; an axle passing through the two connecting ears; a latch having a base with a lower portion, the lower portion forming a handle; two lugs extending from the base, the two lugs defining a space and an inclined plane therebetween, the two lugs fixedly connected to the axle, the handle and an inner side of the base forming a hook rabbet for receiving the rail between the two rear leg tubes; and a torsion spring having a first rest end and a second rest end, the axle passing through the torsion spring, the first rest end urging the bottom side of the top footplate, the second rest end urging the inclined surface so that a torque is provided on the latch.

The top footplate includes a supporting frame and a panel disposed on the supporting frame; the supporting frame encompassing the axle, the torsion spring and the latch.

The intermediate plate rests on the top surface of the panel.

The surface of the handle is provided with hand held grooves.

The step stool further comprises a plastic element having a first location slot and a second location slot on each side, the first location slot fits the curvature of the front leg tubes and touches the inner side of the front leg tubes, the second location slot fits an end of the bottom footplate and touches the end side of the bottom footplate; and a lock pin passing through the front leg tube and the plastic element and locking to the bottom footplate.

The front leg tubes are elliptic tubes, and a cross section of the first location slot is semi-elliptic, conforming to the inner side of the front leg tubes.

The end of the bottom footplate has a smooth surface, and an inclined cross section of the second location slot conforms to the end of the bottom footplate.

The step stool further comprises a second lock pin.

The step stool further comprises a reinforcing rib, the reinforcing rib joining the supporting frame and supporting the panel.

The step stool further comprises a conical frustum shaped plastic element with a base contacting the top footplate, and a cap contacting the front leg tubes; and a lock pin passing through the front leg tubes and the plastic element and locking to the top footplate.

The step stool further comprises a reinforcing rib, the reinforcing rib joining the supporting frame and supporting the panel.

The top footplate includes a base, the base has a panel, the top surface of base substrate is disposed with a plurality of location slots, the bottom side of the location slots has at least one hole running through the panel, every location slot is disposed with an antiskid strip, the bottom of the antiskid strip has at least one button, the button is fastened to the corresponding hole.

The location slots are spaced uniformly and spaced in parallel.

The location slots are parallel to a median plane formed by the two axes of the front leg tubes.

The button has a fastening portion fastening to the bottom side of the antiskid strip, a plugging portion with a conical end and a middle portion disposed between the fastening portion and the plugging portion, the diameter of the middle portion is smaller than that of the hole, the maximum diameter of the plugging portion is larger than that of the hole.

A thickness of the antiskid strip is greater than a depth of the location slot, the top of the antiskid strip is protruded from the top of the panel.

The step stool further comprises a reinforcing rib, the reinforcing rib joining the supporting frame and supporting the panel.

Compared to the existing technology, the present invention has the following advantages:

The latch device, the connecting structure and the footplate have been creatively improved, so that the step stool can be used conveniently and with high reliability. With the hook of the latch hooking the rail in the present invention, the user can release the lock, turn the footplate and fold the step stool by gripping the latch and lifting it up. As the step stool is disposed with torsion spring, it can automatically lock up with high security. The latch device is disposed under the footplate, occupies little space, and provides the top footplate with a holistic and handsome appearance. Both ends of the torsion spring abut the plane and the footplate, respectively. The latch receives a torque, which ensures a reliable latch with high security. The handle is disposed with a hand groove, providing a comfortable hand release.

A plastic element is disposed between each of the leg tubes and the footplate in the present invention. The plastic element has a first location slot which adapts to the shape of the leg tube and connects to the inner side of the leg tube, and a second location slot which adapts the shape of the end of the footplate and connects to the end of the footplate. The plastic element overcomes the disadvantages of the existing step stool, and provides the following advantages:

1. it prevents the bottom footplate to rotate relative to the lock pin and the leg tubes, thereby improving the security and the working life of the step stool;
2. it encases the end of the footplate and the leg tubes, thereby improving the appearance of the step stool;
3. it enhances the connecting strength between the footplate and the leg tubes; and
4. it prevents the end surface of the footplate from scratching the user.

Two lock pins are disposed along the front leg tubes for connecting the bottom footplate with enhanced strength, and preventing rotation of the bottom footplate. The footplate includes a supporting frame, which provides an effective means for connecting an exterior component. The lock pin is a rivet, which is convenient for assembly. The plastic element is conical frustum shaped with the base touching the footplate and the cap touching the leg tubes, which is convenient for the footplate rotation with reduced friction. At the same time, with the plastic element disposed between the leg tubes and the footplate, the footplate can be designed to new antiskid structure, which makes the step stool easily for use and highly reliable.

DETAILED DESCRIPTION OF THE EMBODIMENTS

Figure 1:
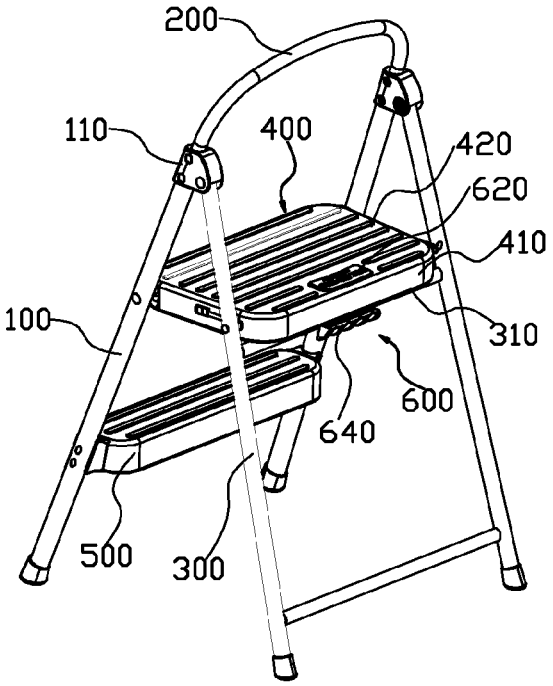
FIG. 1 illustrates a perspective view of the step stool according to a first embodiment.
Figure 2:
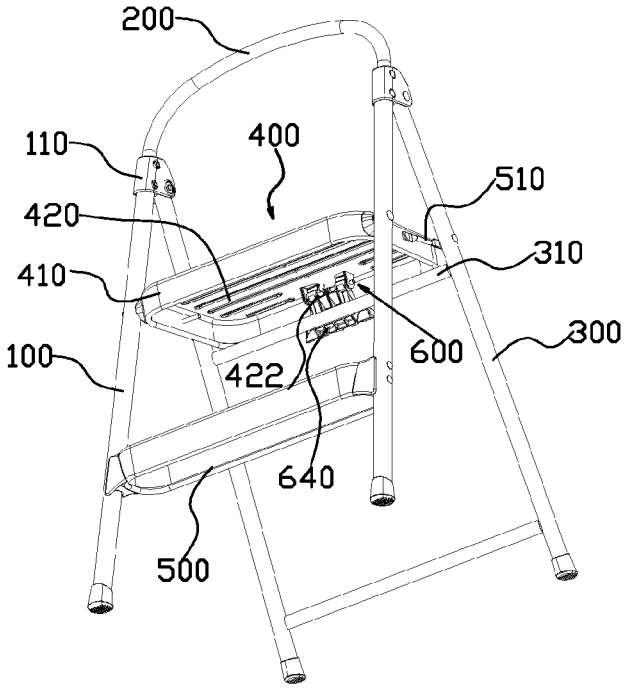
FIG. 2 illustrates another perspective view of the step stool according to the first embodiment.

Referring to FIGS. 1 and 2, the step stool includes two front leg tubes 100, a U-shaped tube 200, two rear leg tubes 300, a top footplate 400, a bottom footplate 500 disposed between the two front leg tubes 100 and a latch device 600.

The end of the U-shaped tube 200 fixes to the top of the front leg tube 100 by a connecting member 110, the top of the rear leg tubes 300 pivotally join the connecting member 110, so that the front leg tubes 100 rotatably connect to the rear leg tubes. A rail 310 is disposed between the two rear leg tubes 300.

Figure 3:
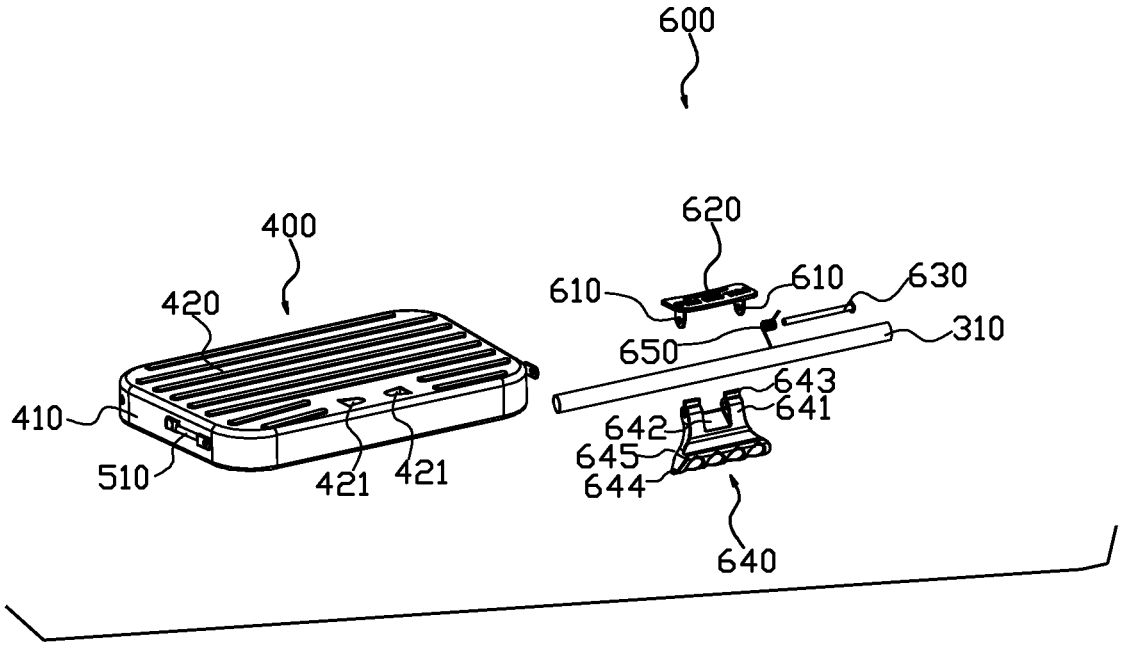
FIG. 3 illustrates a perspective view of the latch device according to the first embodiment.

Referring to FIGS. 1 to 3, the top footplate 400 is stamped integrally by a steel piece or a thin aluminum plate (or injection molded by injection plastic in one step molding). The top footplate 400 includes a rectangle supporting frame 410 and a panel 420 fixed on the supporting frame 410. The front end of the supporting frame 410 pivotally join the two front leg tubes 100. A pivot piece 510 is disposed in the top footplate 400. The front end of the pivot piece 510 pivotally connects the center of the supporting frame 410, and the back end of the pivot piece 510 pivotally joins the rear leg tubes 300. This connecting structure is a known technology, and is not further described for the sake of brevity. Two through holes 421 are disposed side by side, and proximate to the back end of the panel 420. The bottom side of the panel 420 is disposed with a stop 422 between the two holes 421 (two connecting ears 610).

The latch device 600 is disposed in the top footplate 400 and releasably latches the rail 310. The latch device 600 includes two connecting ears 610, a middle plate 620, an axle 630, a latch 640 and a torsion spring 650.

The middle plate 620 is fixed to the two connecting ears 610, and arranges the connecting ears 610 with a space therebetween. The connecting ears 610 run through the holes 421 to protrude from the bottom side of the panel 420. The middle plate 620 rests on the top side of the panel 420, which makes the middle plate 620, two connecting ears 610 and the panel 420 are connected.

The axle 630 passes through the two connecting ears.

The latch 640 has a base. Two lugs 641 extend from each side of the base defining a space and an inclined plane 642 therebetween. The top of the lugs 641 is disposed with a protruding piece 643. The two lugs 641 are fixed to the axle 630, so that the latch 640 rotates in relation to the axle 630. The distance between the end of the protruding piece 643 and the axis of the axle 630 is greater than the distance between the stop 422 and the axis of the axle 630, so that the stop 422 limits the maximum rotation angle of the latch 640, preventing the latch 640 from excessive rotation and the torsion spring 650 from excessive compression, and thus shortening the life of the torsion spring 650. The lower portion of the base forms a handle 644. The handle 644 extends from the inner side of the base, so that a hook rabbet 645 is formed between the handle 644 and the inner side of the base which spans the entire width of the base. The surface of the handle 644 is disposed with grooves matching a shape of the fingers.

The axle 630 interlinks the torsion spring 650, which has two rest ends. The first rest end urges the bottom side of the panel 420, and the second rest end urges the inclined surface 642 of the latch 640, providing a torque on the latch 640.

Figure 4:
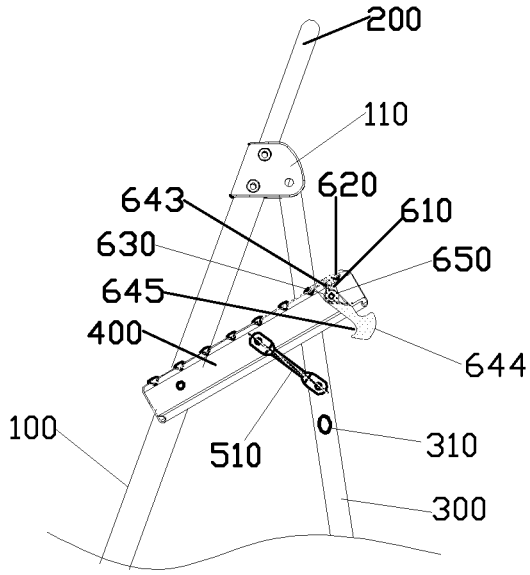
FIG. 4 illustrates a sectional view of the latch device in a first position according to the first embodiment.
Figure 5:
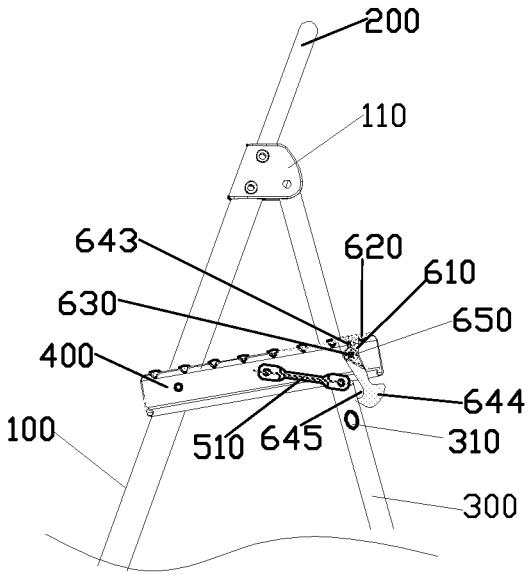
FIG. 5 illustrates a sectional view of the latch device in a second position according to the first embodiment.
Figure 6:
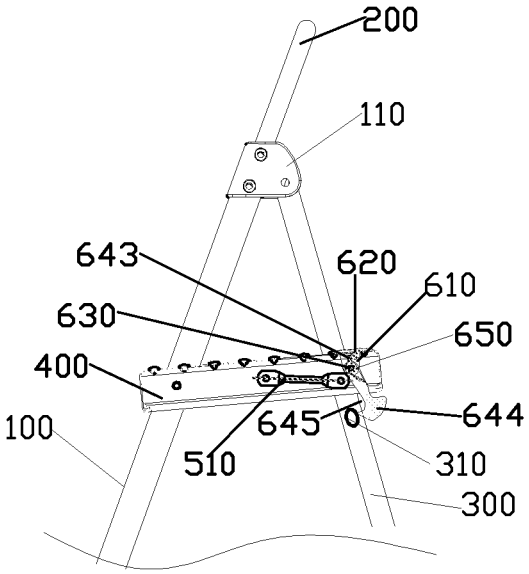
FIG. 6 illustrates a sectional view of the latch device in a third position according to the first embodiment.
Figure 7:
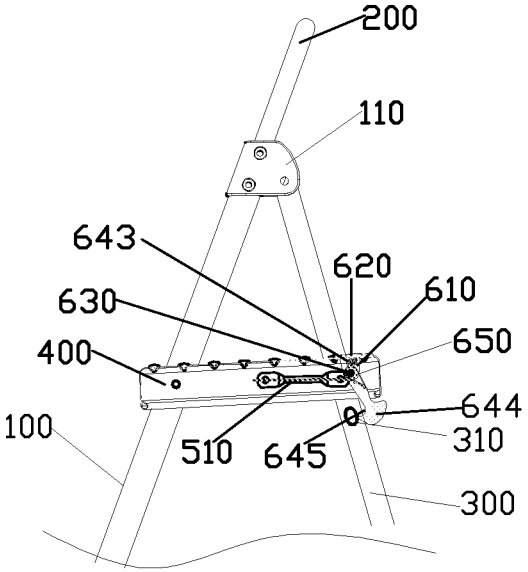
FIG. 7 illustrates a sectional view of the latch device in a fourth position according to the first embodiment.
Figure 8:
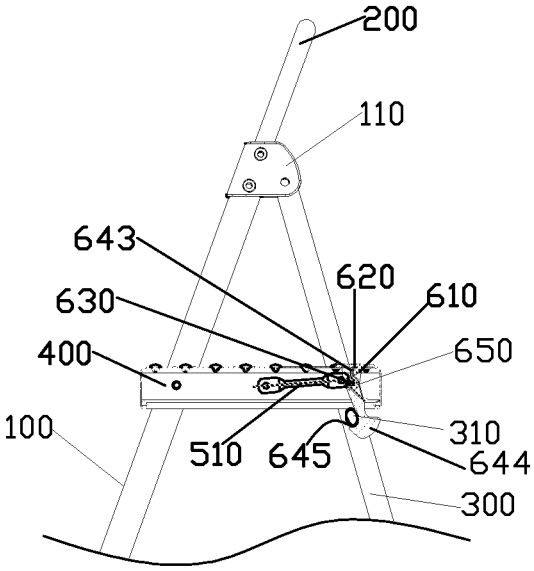
FIG. 8 illustrates a sectional view of the latch device in a locking position according to the first embodiment.
Figure 9:
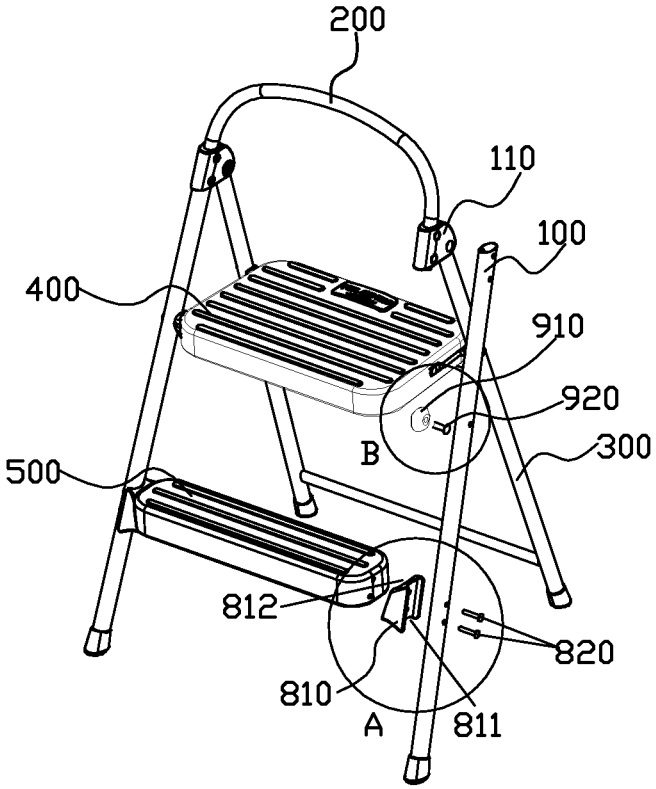
FIG. 9 illustrates a decomposition diagram of the step stool according to the first embodiment.
Figure 10:
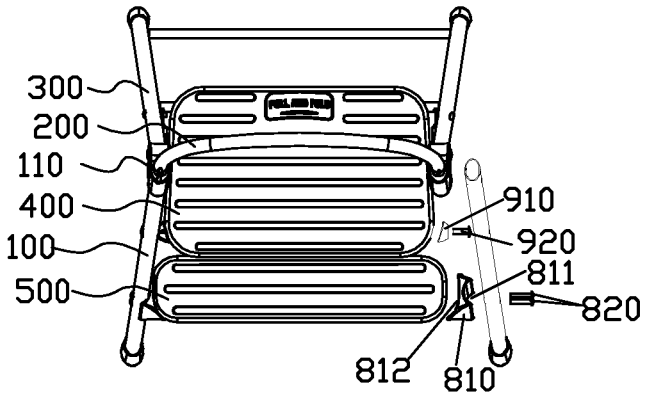
FIG. 10 illustrates a top view of FIG. 9.
Figure 11:
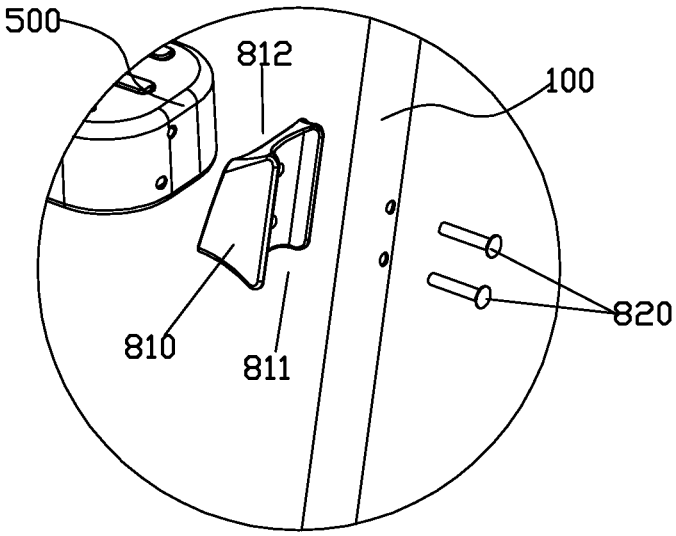
FIG. 11 illustrates an enlarged view of A in FIG. 9.
Figure 12:
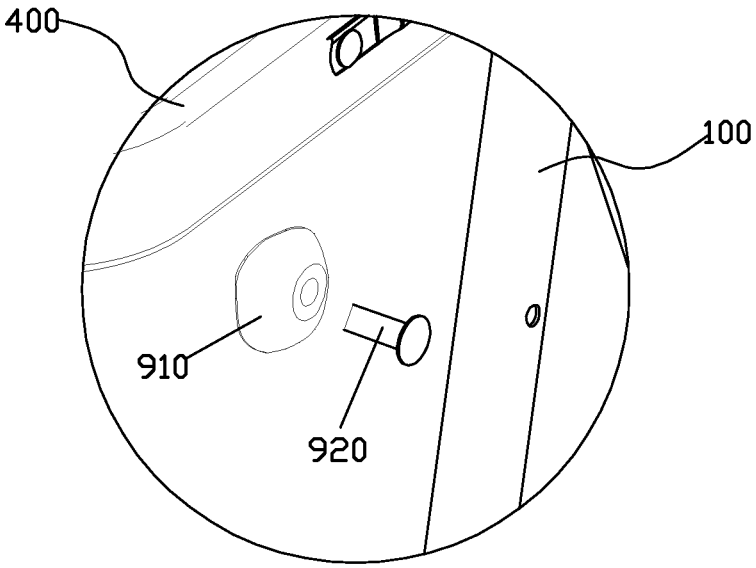
FIG. 12 illustrates an enlarged view of B in FIG. 9.
Figure 13:
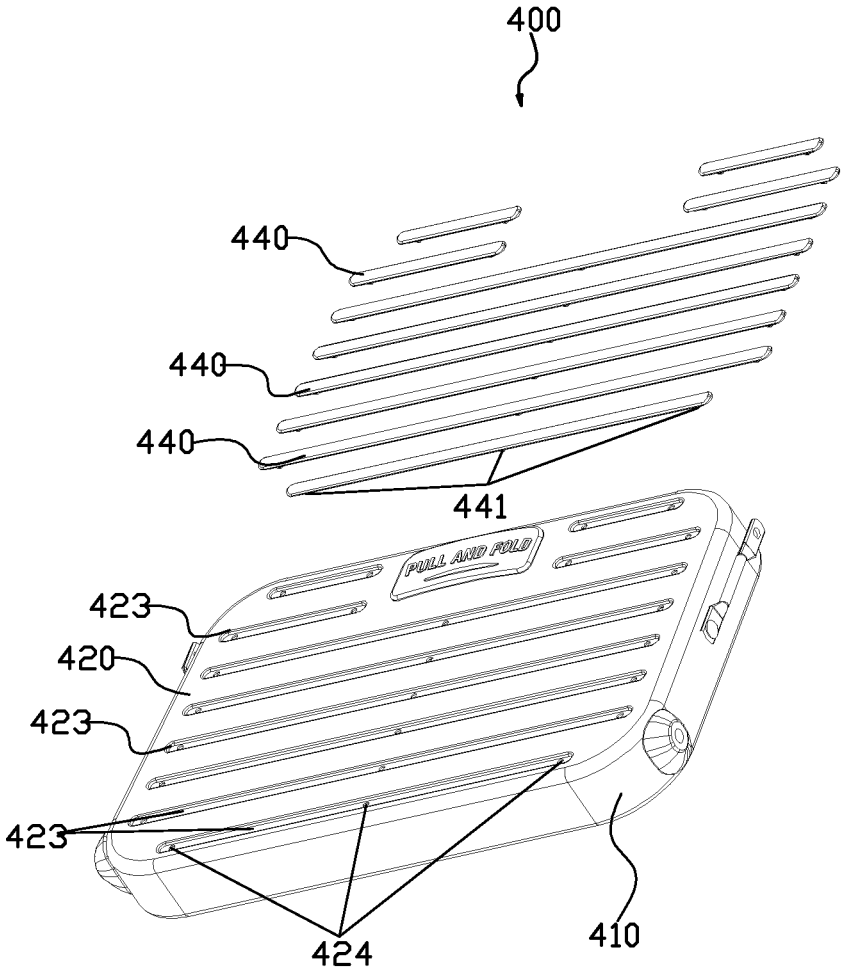
FIG. 13 illustrates a decomposition diagram of the top footplate according to the second embodiment.
Figure 14:
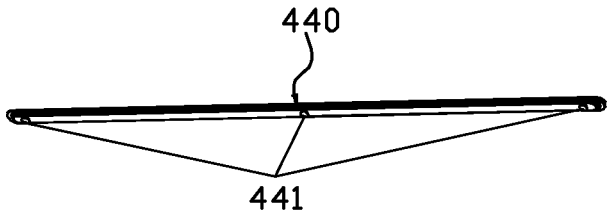
FIG. 14 illustrates the schematic diagram of the antiskid strip according to the second embodiment.
Figure 15:
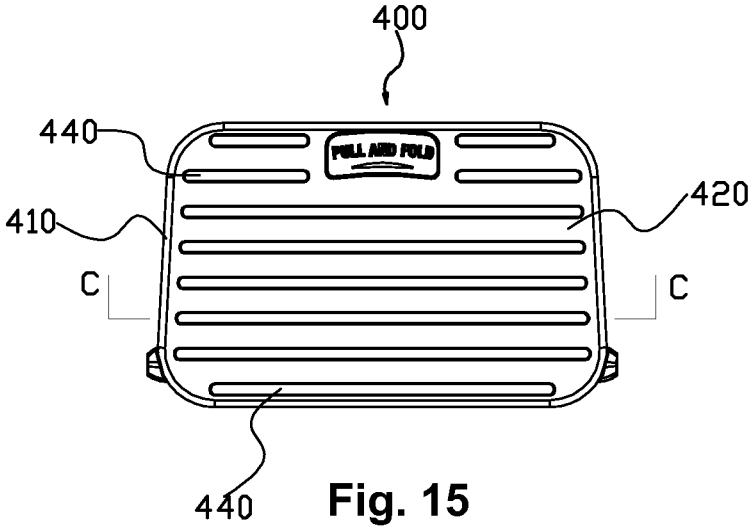
FIG. 15 illustrates a top view of the top footplate according to the second embodiment.
Figure 16:
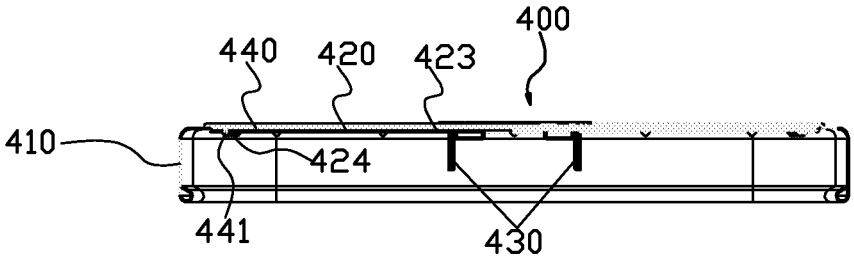
FIG. 16 illustrates a sectional diagram along the line C-C in FIG. 15.

Referring to FIGS. 4 to 8, which illustrate the latching sequence of the latch 640, which also includes:

1. unfolding the front leg tubes 100 and the rear leg tubes 300, the top footplate turns clockwise, as shown in FIGS. 4 and 5;
2. continuing unfolding the front leg tubes 100 and the rear leg tubes 300, or turning the top footplate clockwise until the inner part of the handle 644 of the latch 640 touches the rail 310, as shown in FIGS. 6 and 7; and
3. further continuing with unfolding the front leg tubes 100 and the rear leg tubes 300, or turning the top footplate clockwise; the inner part of the hook rabbet 645 touches the rail 310 and slips down the rail 310 (getting over the deformation spring force); when slipping to a certain position, the latch turns clockwise in the torque of the torsion spring, the hook rabbet 645 hooks the rail 310 from outside to inside, the supporting frame 410 supports the rail 310 at this time, and the latch device 600 is in the status of lock, as shown in FIG. 8.

The connecting structure to connect the footplate and the leg tubes is described in FIGS. 9 to 12. The bottom footplate 500 is fixed between the two front leg tubes 100. The connecting structure to connect the bottom footplate 500 and the front leg tubes 100 includes a first plastic element 810 and two first lock pins 820. The right and the left side of the first plastic element 810 are disposed with the first location slot 811 and the second location slot 812 separately. The first location slot 811 fits the front leg tubes 100, the inclined plane of the first location slot 811 fits the semi ellipse of the inner side of the front leg tubes 100 in this embodiment. The second location slot 812 fits the end of the bottom footplate 500, the inclined plane of the second location slot 812 fits the curvature of the end of the bottom footplate 500 in this embodiment. The first plastic element 810 is disposed between the bottom footplate 500 and the front leg tubes 100, beside the first location slot 811 abuts the inner side of the front leg tubes 100, the second location slot 812 abuts the end of the bottom footplate 500.

The two first lock pins 820 are disposed with space along the direction of the front leg tube. The first lock pin 820 is a rivet, which passes through the supporting frame and rivets the front leg tubes 100, the first plastic element 810 and the bottom footplate 500.

The top footplate 400 rotates between the two front leg tubes 100. The connecting structure connecting the top footplate 400 and the front leg tubes 100 includes a second plastic element 910 and a second lock pin 920. The second plastic element 910 is conical frustum shaped with a base and a cap. The second plastic element 910 is disposed between the top footplate 400 and the front leg tubes 100, and the base of the second plastic element 910 contacts the top footplate 400 while the cap contacts the front leg tubes 100.

The second lock pin 920 is a rivet which passes through the supporting frame which rivets the front leg tubes 100, the second plastic element 910 and the top footplate 400.

With the plastic element disposed between the leg tubes and the footplate in the embodiment of the present invention, the first location slot fits the leg tubes and touches the inner side of the leg tube; the second location slot fits the end of the footplate and touches the end of the footplate. The present invention has the following advantages:

1. it prevents the footplate from rotating relative to the lock pin and the leg tubes, thereby improving the security and the working life of the step stool;
2. the location slots of the plastic element wrap the end of the footplate and the leg tubes, thereby improves the appearance of the step stool;
3. it enhances the connecting strength between the footplate and the leg tubes; and
4. it prevents the end surface of the footplate from scratching the user.

Two lock pins are disposed along the front leg tubes for connecting the bottom footplate with enhanced strength, and preventing rotation of the top footplate. The footplate includes a supporting frame, which provides an effective means for connecting the exterior component. The lock pin is a rivet, which is convenient for assembling. The plastic element is conical frustum shaped with the base touching the footplate and the cap touching the leg tubes, which is convenient for the footplate rotation with reduced friction. At the same time, with the plastic element disposed between the leg tubes and the footplate, the footplate can be designed to new antiskid structure, which makes the step stool easily for use and highly reliable.

In accordance with a second embodiment of the present invention, the step stool includes two front leg tubes 100, a U-shaped tube 200, two rear leg tubes 300, a top footplate 400, a bottom footplate 500 fixed between the two front leg tubes 100 and a latch device 600.

The end of the U-shaped tube 200 fixes to the top of the front leg tubes by a connecting member 110, the top of the rear leg tubes 300 pivotally join the connecting member 110, so that the front leg tubes 100 rotatably connect to the rear leg tubes. A rail 310 is disposed between the two rear leg tubes 300. (refer to FIGS. 1 and 2).

Referring to FIGS. 13 to 16, the top footplate 400 includes a base made from aluminum alloy and several antiskid strips 440 made from plastic.

The base is disposed with a rectangular supporting frame 410, a panel 420 and reinforcing ribs 430, the panel 420 is fixed on the supporting frame 410 and made in one step. The reinforcing ribs 430 join the supporting frame 410 and supports the panel 420. The top of the panel 420 is disposed with location slots 423 with corresponding antiskid strips 440. These location slots 423 are spaced uniformly and in parallel, and parallel to the median plane formed by the two axes of the front leg tubes 100. The bottom side of the location slots 423 is provided with several holes 424 running through the panel 420.

The bottom of the antiskid strip is disposed with several buttons 441 corresponding to the number of the holes 424. The buttons 441 are provided with a fasten portion fastening to the bottom side of the antiskid strip, a plugging portion with a conical end and a middle portion disposed between the fasten portion and plugging portion on the bottom side of the antiskid strips 440. The diameter of the middle portion is smaller than that of the holes 424; the maximum diameter of the plugging portion is larger than that of the holes 424, while the minimum diameter is smaller than the diameter of the holes 424.

These antiskid strips 440 fit the location rabbet 423. These antiskid strips 440 are disposed in the corresponding location rabbet 423. The buttons 441 fit the holes 424 in a one-to-one relationship. The loop step surface of the simply plugged portion touches the bottom side of the panel 420.

The thickness of the antiskid strip 440 is greater than the depth of the location slot 423, the top of the antiskid strip 440 is protrudes from the top of the panel 420.

In another preferred embodiment whereby the difference from the last preferred embodiment is: the button is disposed with a fastening portion fastening to the bottom side of the antiskid strip, a plugging portion with a conical end fastening to the middle portion. The diameter of the middle portion is smaller than that of the hole, the maximum diameter of the plugging portion is greater than that of the hole.

In another preferred embodiment, the difference from the last preferred embodiment is: the base is made from injection molding.

The footplate of the embodiment in the present invention has the following advantages:

1. the antiskid footplate is provided with antiskid strips, which enhance the antiskid effect of the footplate and the security;
2. the antiskid strip is provided in the location slot and assembled with the through hole and the button, providing an easy and fast assembly;
3. the antiskid strip prevents or reduces the abrasion of the antiskid footplate with high reliability (the antiskid footplate generally undergoes a surface treatment, such as spraying and galvanization, and is prone to scratching and abrasion), the antiskid strip reduces the bottom of the feet touching the antiskid footplate surface;
4. the antiskid strip is used to reinforce the antiskid footplate;
5. the antiskid strip enhances the appearance of the antiskid footplate, and provides variety of the appearance;
6. the location slots parallel to the median plane formed by the two axes of the upright columns with pointed antiskid and high reliability (as the bottom of the feet is placed perpendicular to the plane of the footplate, the direction of the antiskid strip is pointed antiskid.);
7. the end of the plugging portion is cone shaped, which is convenient for assembling and lock catch;
8. the diameter of the middle portion is smaller than that of the through hole, the maximum diameter of the plugging portion is greater than that of the hole, so that the latch is firm;
9. the top of the antiskid strip protrudes out of the top side of the panel, the antiskid effect is good, which prevents the abrasion of the antiskid footplate; and
10. the panel is fixed on the supporting frame, the reinforcing ribs connect to the supporting frame and supports the panel with a high supporting strength, the supporting frame is convenient for connecting exterior components.

Although the present invention has been described with reference to the preferred embodiments thereof for carrying out the invention, it is apparent to those skilled in the art that a variety of modifications and changes may be made without departing from the scope of the present invention which is intended to be defined by the appended claims.

INDUSTRIAL APPLICABILITY

The present invention is provided with a step stool, which is provided with a latch device and the connecting structure between the footplate and the leg tubes of simple usage and high reliability for the top footplate. The top footplate is designed to be an antiskid footplate with a simple structure, easy to use and with a high industrial applicability.

What is claimed is:

1. A step stool comprising:

two front leg tubes;

two rear leg tubes, the two rear leg tubes joining the two front leg tubes pivotally, the two rear leg tubes having a rail therebetween;

a bottom footplate attached between the two front leg tubes;

a top footplate having a front end and a back end, the front end of the top footplate pivotably coupled to the two front leg tubes, the top footplate having two holes proximate to the back end, the back end of the footplate resting on the rail;

a latch device located at the back end of the top footplate, the latch device comprising:

a middle plate with two connecting ears, the two connecting ears passing through the holes of the top footplate and emerging from a bottom side of the top footplate;

an axle passing through the two connecting ears;

a latch having a base with a lower portion, the lower portion forming a handle; two lugs extending from the base, the two lugs defining a space and an inclined plane therebetween, the two lugs fixedly connected to the axle, the handle and an inner side of the base forming a hook rabbet for receiving the rail connecting the two rear leg tubes, the hook rabbet extending the entire width of the base; and a torsion spring having a first rest end and a second rest end, the axle passing through the torsion spring, the first rest end urging against the bottom side of the top footplate, the second rest end urging against the inclined surface so that a torque is provided on the latch.

2. The step stool according to claim 1, wherein the top footplate includes a supporting frame and a panel disposed on the supporting frame; the supporting frame encompassing the axle, the torsion spring and the latch.

3. The step stool according to claim 1, wherein the intermediate plate rests on the top surface of the panel.

4. The step stool according to claim 1, wherein the surface of the handle is provided with hand held grooves.

5. The step stool according to claim 1, further comprising:

a plastic element having a first location slot on a first side and a second location slot on a second side, the first location slot fits the curvature of the front leg tubes and touches the inner side of the front leg tubes, the second location slot fits an end of the bottom footplate and touches the end side of the bottom footplate; and a lock pin passing through the front leg tube and the plastic element and locking to the bottom footplate.

6. The step stool according to claim 5, wherein the front leg tubes are elliptic tubes, and a cross section of the first location slot is semi-elliptic, conforming to the inner side of the front leg tubes.

7. The step stool according to claim 5, wherein the end of the bottom footplate has a smooth surface, and a inclined cross section of the second location slot conforms to the end of the bottom footplate.

8. The step stool according to claim 5, further comprising a second lock pin.

9. The step stool according to claim 2, further comprising a reinforcing rib, the reinforcing rib joining the supporting frame and supporting the panel.

10. The step stool according to claim 1, further comprising:

a conical frustum shaped plastic element with a base contacting the top footplate, and a cap contacting the front leg tubes; and a lock pin passing through the front leg tubes and the plastic element and locking to the top footplate.

11. The step stool according to claim 10, further comprising a reinforcing rib, the reinforcing rib joining the supporting frame and supporting the panel.

12. The step stool according to claim 1, wherein the top footplate includes a base, the base has a panel with a plurality of location slots, the bottom side of the location slots has at least one hole running through the panel, every location slot is disposed with an antiskid strip, the bottom of the antiskid strip has at least one button, the button is fastened to the corresponding hole.

13. The step stool according to claim 12, wherein the location slots are spaced uniformly and spaced in parallel.

14. The step stool according to claim 12, wherein the button has a fastening portion fastening to the bottom side of the antiskid strip, a plugging portion with conical end and a middle portion disposed between the fastening portion and the pluffing portion, the diameter of the middle portion is smaller than that of the hole, the maximum diameter of the plugging portion is larger than that of the hole.

15. The step stool according to claim 12, wherein a thickness of the antiskid strip is greater than a depth of the location slot, the top of the antiskid strip is protruded from the top of the panel.

16. The step stool according to claim 12, further comprising a reinforcing rib, the reinforcing rib joining the supporting frame and supporting the panel.

* * * * *